US005650811A

United States Patent [19]

Seccombe et al.

[11] Patent Number: 5,650,811

[45] Date of Patent: Jul. 22, 1997

[54] APPARATUS FOR PROVIDING INK TO A PRINTHEAD

[75] Inventors: S. Dana Seccombe, Foster City; Jon J. Fong, San Diego, both of Calif.

[73] Assignee: Hewlett-Packard Company, Palo Alto, Ga.

[21] Appl. No.: 409,255

[22] Filed: Mar. 23, 1995

Related U.S. Application Data

[63] Continuation-in-part of Ser. No. 65,957, May 21, 1993, abandoned.

[51] Int. Cl.[6] ..... B41J 2/17

[52] U.S. Cl. ..... 347/85; 347/94

[58] Field of Search ..... 347/84, 85, 86, 347/87, 92, 93, 7, 6, 17, 94

[56] References Cited

U.S. PATENT DOCUMENTS

| | | | |
|---|---|---|---|
| 4,475,116 | 10/1984 | Sicking et al. | 347/86 |
| 4,490,728 | 12/1984 | Vaught et al. | 347/60 |
| 4,509,062 | 4/1985 | Low et al. | 347/87 |
| 4,677,447 | 6/1987 | Nielsen | 347/87 |
| 4,831,389 | 5/1989 | Chan | 347/86 |
| 4,885,595 | 12/1989 | Kaplinsky et al. | 347/85 |
| 4,959,667 | 9/1990 | Kaplinsky et al. | 347/87 |
| 4,968,998 | 11/1990 | Allen | 347/87 X |
| 4,973,993 | 11/1990 | Allen | 347/87 X |
| 4,992,802 | 2/1991 | Dion et al. | 347/87 |
| 5,325,119 | 6/1994 | Fong | 347/86 |

FOREIGN PATENT DOCUMENTS

| | | |
|---|---|---|
| 04 96 620 | 7/1992 | European Pat. Off. . |
| 63-256451 | 10/1988 | Japan . |
| 1-244862 | 9/1989 | Japan . |

*Primary Examiner*—John E. Barlow, Jr.
*Attorney, Agent, or Firm*—Edward Maker, II; Ron Griffin

[57] ABSTRACT

An ink-jet printing system having a pressurized ink reservoir. Ink at elevated pressure is supplied to a back pressure regulator which reduces the pressure down for use by conventional ink-jet printhead. The ink reservoir can be either stationary and off-axis or movable and onboard with the printhead.

18 Claims, 9 Drawing Sheets

ID H 1.270 88/03/15

2746 Internal Courier

2746 Internal Courier

2746 Internal Courier

FIG. 11

APPARATUS FOR PROVIDING INK TO A PRINTHEAD

CROSS REFERENCE TO RELATED APPLICATION

This is a continuation-in-part of application Ser. No. 08/065,957 filed May 21, 1993 now abandoned.

BACKGROUND OF THE INVENTION

The present invention relates generally to the field of ink-jet printing and, more particularly, to the delivery of ink and the control of ink pressures in ink-jet printheads.

Ink-jet printers have gained wide acceptance. These printers are described by W. J. Lloyd and H. T. Taub in "Ink-Jet Devices," Chapter 13 of *Output Hardcopy Devices* (Ed. R.C. Durbeck and S. Sherr, Academic Press, San Diego, 1988) and by U.S. Pat. No. 4,490,728. Ink-jet printers produce high quality print, are compact and portable, and print quickly but quietly because only ink strikes the paper. The major categories of in- jet printer technology include continuous ink-jet, intermittent ink-jet, and drop on demand ink-jet. The drop on demand category can be further broken down into piezoelectric ink-jet printers and thermal ink-jet printers. The typical thermal ink-jet printhead has an array of precisely formed nozzles attached to a thermal ink-jet printhead substrate that incorporates an array of firing chambers that receive liquid ink (i.e., colorants dissolved or dispersed in a solvent) from an ink reservoir. Each chamber has a thin-film resistor, known as a "firing resistor", located opposite the nozzle so ink can collect between it and the nozzle. When electric printing pulses heat the thermal ink-jet firing resistor, a small portion of the ink near it vaporizes and ejects a drop of ink from the printhead. Properly arranged nozzles form a dot matrix pattern. Properly sequencing the operation of each nozzle causes characters or images to form on the paper as the printhead moves past the paper.

Ink delivering systems for conventional ink-jet printheads deliver ink at a slight vacuum, known as a "back pressure", so that the ink does not leak out of the nozzles. Typically, this slight vacuum is approximately two to three inches of water below atmospheric pressure. The back pressure can be created by positioning the ink reservoir below the printhead so that the system equilibrates with a slight vacuum inside the printhead. Alternatively, a slightly negative back pressure can be created using a spring to pull a bladder membrane outward to create a slight negative pressure inside the ink reservoir. This approach is described in U.S. Pat. No. 4,509,602 entitled "Ink Reservoir With Essentially Constant Negative Back Pressure", issued Apr. 2, 1985 and assigned to the assignee of this invention.

Today most conventional ink-jet printheads have an "onboard ink reservoir". In other words, the ink reservoir is physically attached to the printhead and moves with it during printing operations. As the printhead and the ink reservoir move back and forth across the page, the ink accelerates and decelerates and consequently develops pressure surges that can deprime or discharge ink from the printhead. Some previously known onboard ink supplies have a block of foam in the ink reservoir to create the back pressure through capillary action and to prevent the ink from sloshing and developing pressure surges. The foam occupies a large fraction of the ink reservoir volume and thus reduces the capacity of the ink reservoir.

Some ink-jet printheads have "off-axis ink reservoir systems". These systems use a small flexible tube to transport ink from a stationary ink reservoir to a moving printhead.

When the supply of ink is low, the user replaces only the ink reservoir. Like onboard systems, acceleration and deceleration of the printhead and the flexible tube create pressure surges that can either deprime or discharge ink from the printhead.

The relative heights of the printhead and off-axis ink reservoir influence the back pressure of the ink-jet printhead. Many previously known systems set the back pressure by using a wide and shallow reservoir placed at a height to produce a slightly negative pressure in the ink-jet printhead. Since the reservoir is shallow, its level does not change much and the back pressure of the ink-jet printhead does not change much. The problem with this arrangement is that tilting the printer can disrupt the operation of the printhead. Another problem is the low ink capacity of a shallow ink reservoir.

One off-axis ink reservoir system is described in Japanese patent document no. 63-256451 (Japanese Serial No. 62-91304) by Kurashima published Oct. 24, 1988.

SUMMARY OF THE INVENTION

For the reasons previously discussed, it would be advantageous to have a small inexpensive back pressure regulator for ink-jet printheads.

Briefly and in general terms, an apparatus according to the present invention includes a pressure regulator for receiving ink from a reservoir and for delivering ink to a conventional printhead at a pressure of about minus two inches of water.

A pressurized ink delivery system permits the use of smaller diameter ink conduits which have greater mechanical flexibility than the larger conventionally used conduits. This feature is of major importance when designing miniature products. The use of small diameter conduits also means that the interior surface area of the conduits exposed to the ink is smaller, and thus, the ink is subject to less diffusion and water loss. Also, a pressurized ink supply system allows more choice in the design of the printer and the location of the ink reservoir with respect to the printhead. The inertial mass of the printhead and the carriage can also be reduced because the mass of the reservoir is no longer in motion. There is less inertial mass for the carriage to move and a much cheaper printer can be developed. Finally, print quality is improved because the printhead can be more closely engineered to operate at a uniform pressure set by the pressure regulator. The printhead is not subject to changes in pressure due to variations in level of the ink supply.

The pressure regulator of the present invention includes a miniature, lightweight, plastic pressure regulator located inside a print cartridge (i.e., outer packaging that holds and protects the printhead) that maintains the back pressure (i.e., the slightly negative gauge pressure that the ink inside the printhead is held to prevent it from leaking out) of the ink-jet printhead at a constant value over the full range of printer output speeds, the full range of print densities, and over the full range of ink reservoir pressures. The pressure regulator has a low friction valve, a diaphragm for exerting an opening force on the valve, and a spring that exerts a closing force on the valve. The low friction valve has a nozzle, a valve seat, and a lever or other device for low friction movement of the valve seat. The present invention overcomes the sealing problems of previously employed check valves by using a nozzle with a very small inner diameter that allows high sealing pressures. The force exerted by the diaphragm when the back pressure equals the set-point pressure (i.e., the desired value of the back pressure that keeps ink from leaking out of the nozzles) and the spring force are more than five times the maximum force of the ink inside the nozzle. To provide adequate flow, the present invention may deliberately apply positive pressure to the ink reservoir to achieve adequate flow into the ink-jet printhead. The present invention can regulate the back pressure of ink-jet printheads having either an onboard ink reservoir system or an off-axis ink reservoir system.

The pressure regulator of the present invention has many advantages. Besides the pressure regulator being small and having low mass, it eliminates problems that have plagued previously known off-axis systems so that a high performance printhead can use an off-axis ink reservoir. The resulting print cartridge is small and has low mass so that the printer incorporating this invention can have high performance in a small package. Another advantage of the present invention is that the back pressure of the ink-jet printhead remains constant despite motion of the printhead or the orientation of the printer so that the printhead can print at any angle or speed. Additionally, an ink- jet printhead with the present invention can have a constant, slightly negative back pressure even though the ink reservoir is pressurized to improve the delivery of ink. Another advantage of the present invention is its insensitivity to changes in printer output speeds, to changes in print density, and to variations in the pressure of the reservoir. Another advantage of pressure regulator is its small size that allows placement of multiple pressure regulators on one print cartridge. This permits construction of compact multi-color print cartridges that print 2–7 colors (or more) and that have dimensions of 2"×1"×0.2" or less. Also, it allows construction of print cartridges using multiple component inks such a pigment component and stabilizing component that would be ejected from different ink-jet printheads. Another advantage of the present invention is that placement of many pressure regulators across a page-wide print cartridge make it insensitive to tilting. With a pressurized ink delivery system, a print head can be insensitive to orientation and a page-width print cartridge can be mounted in any orientation—either horizontal, vertical, or in between. Another advantage of the present invention is that an ink-jet printhead can be removed from the print cartridge without depriming or disconnecting the ink reservoir because the pressure regulator associated with that printhead shuts-off the flow of ink when the printer is not being used. Another advantage of the pressure regulator is its ability to maintain the back pressure constant so that the print does not develop striations due to dot size variations Furthermore, the pressure regulator is inexpensive.

Other aspects and advantages of the invention will become apparent from the following detailed description, taken into conjunction with the accompanying drawings, illustrating by way of example the principles of the invention.

BRIEF DESCRIPTION OF THE DRAWINGS

FIG. 11 shows a sample of print produced by a printer incorporating the present invention.

DESCRIPTION OF THE PREFERRED EMBODIMENTS

Figure 1:
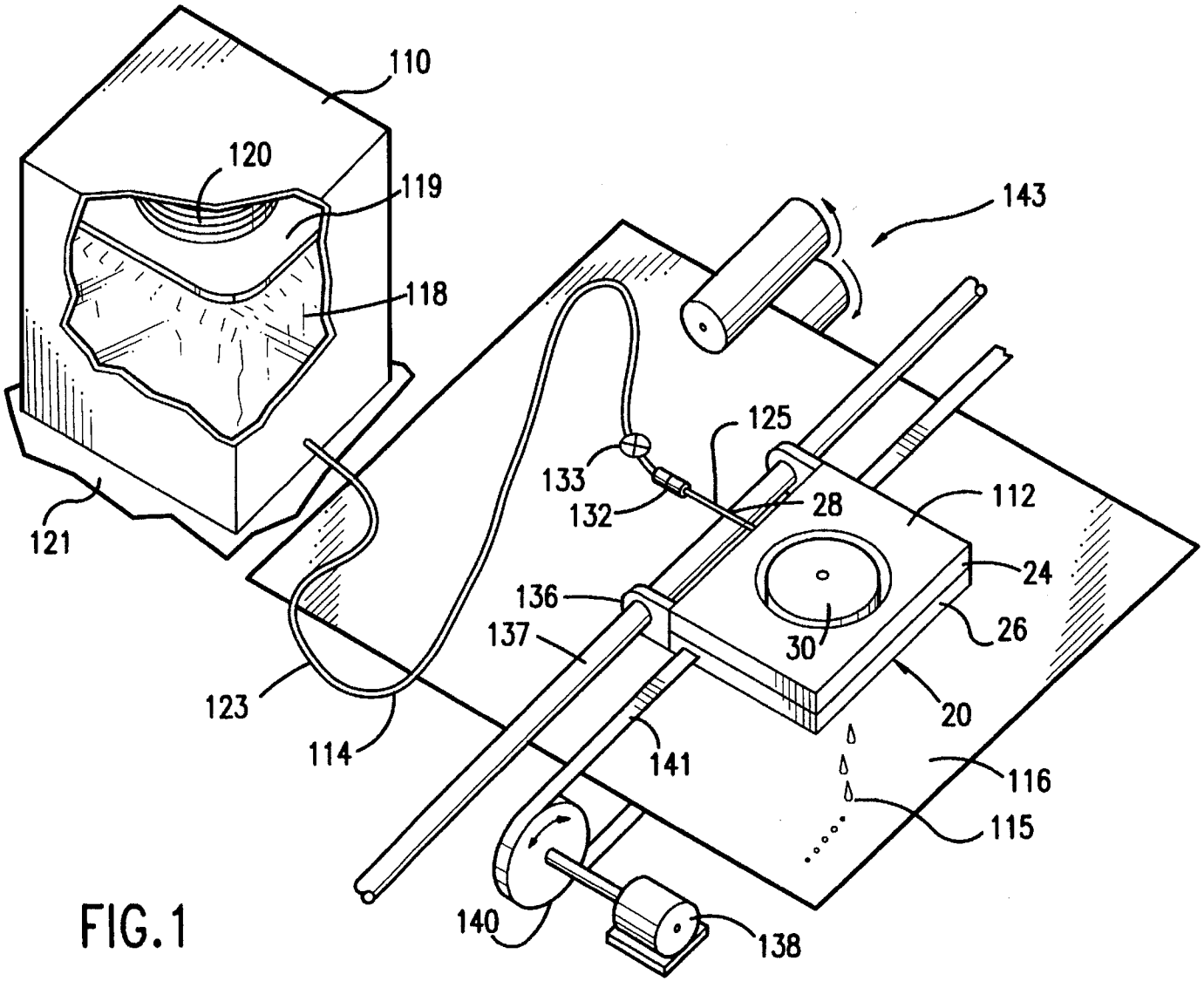
FIG. 1 is a diagrammatic perspective view, with certain portions cut away, of an apparatus for providing ink to a printhead according to the present invention

As shown in the drawings for the purposes of illustration, the invention is embodied in an apparatus for providing ink to a printhead. The ink is stored in a reservoir that either is remotely mounted off-axis and stationary with respect to the printhead or is movable and mounted onboard with the printhead. A pressure regulator receives ink from the ink reservoir and delivers ink to the printhead at a pressure of about minus two to three inches of water.

Referring to FIG. 1, reference numeral 110 indicates an ink reservoir for storing ink at a pressure of between minus two inches (–2") of water to an excess of atmospheric pressure. The reservoir is connected to a printhead assembly 112 by an ink conduit 114. The printhead assembly illustrated in FIG. 1 is in the process of ejecting droplets 115 of ink onto a print medium 116.

Referring in particular to FIG. 1, the ink reservoir 110 contains a deformable bag 118 that contains liquid ink, not shown. The deformable bag is pressurized by a piston 119 that is urged downward by the expansion of a coiled spring 120. The piston 119 and spring 120 raise the pressure of the ink to a level in excess of the level obtained by gravitational force. Typical reservoir pressures are contemplated to be about one pound per square inch although operating pressures as high as thirty pounds per square inch and as low as minus one tenth of a pound per square inch have been successfully tested. The reservoir 110 is releasably retained within the printer (only partially shown) by a stationary mounting 121. The stationary mounting for the reservoir can be placed either at the same level of the printhead 110 or above it or below it as the design of the printer may dictate.

Referring to FIG. 1, the reservoir 110 is connected to the print head assembly 112 by an ink conduit 114 comprising two conduit portions 123 and 125. The conduit has a small internal diameter and a low vapor transmission rate in order to reduce the diffusion of water from the ink in the conduit. The ink conduit 114 further includes a mechanical coupling 132 which permits the ink reservoir 110 and the portion 123 of the ink conduit to be separated from the print head assembly 112 and its conduit 125. Separation of the ink conduit and removal of the reservoir is effected by closing an isolation valve 133 which is normally open during operation.

Figure 2A:
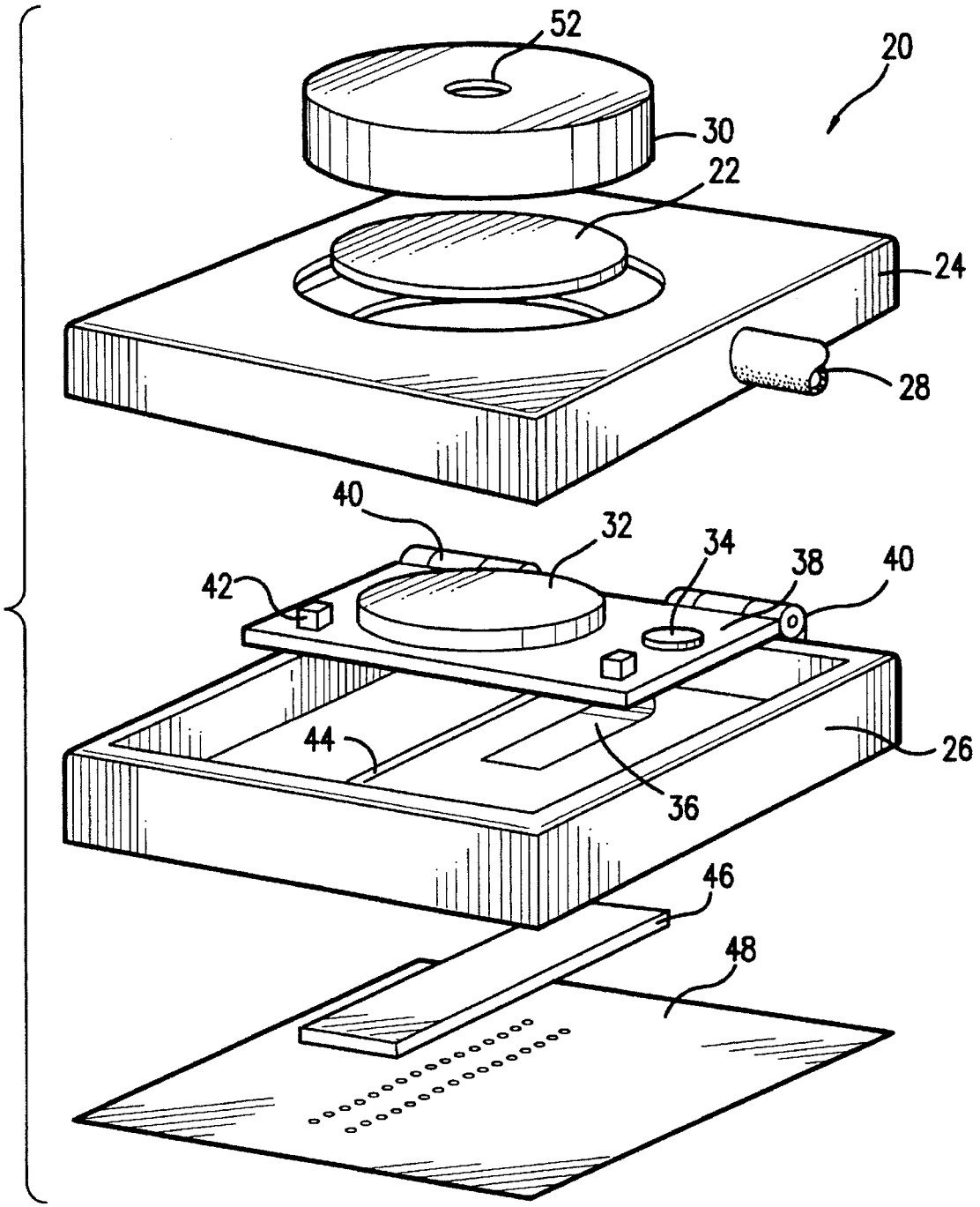
FIGS. 2A and 2B show exploded views of the preferred embodiment of the back pressure regulator from different perspectives, the perspective of FIG. 2A is from the side and slightly above the back pressure regulator and the perspective of FIG. 2B is taken from below the back pressure regulator
Figure 2B:
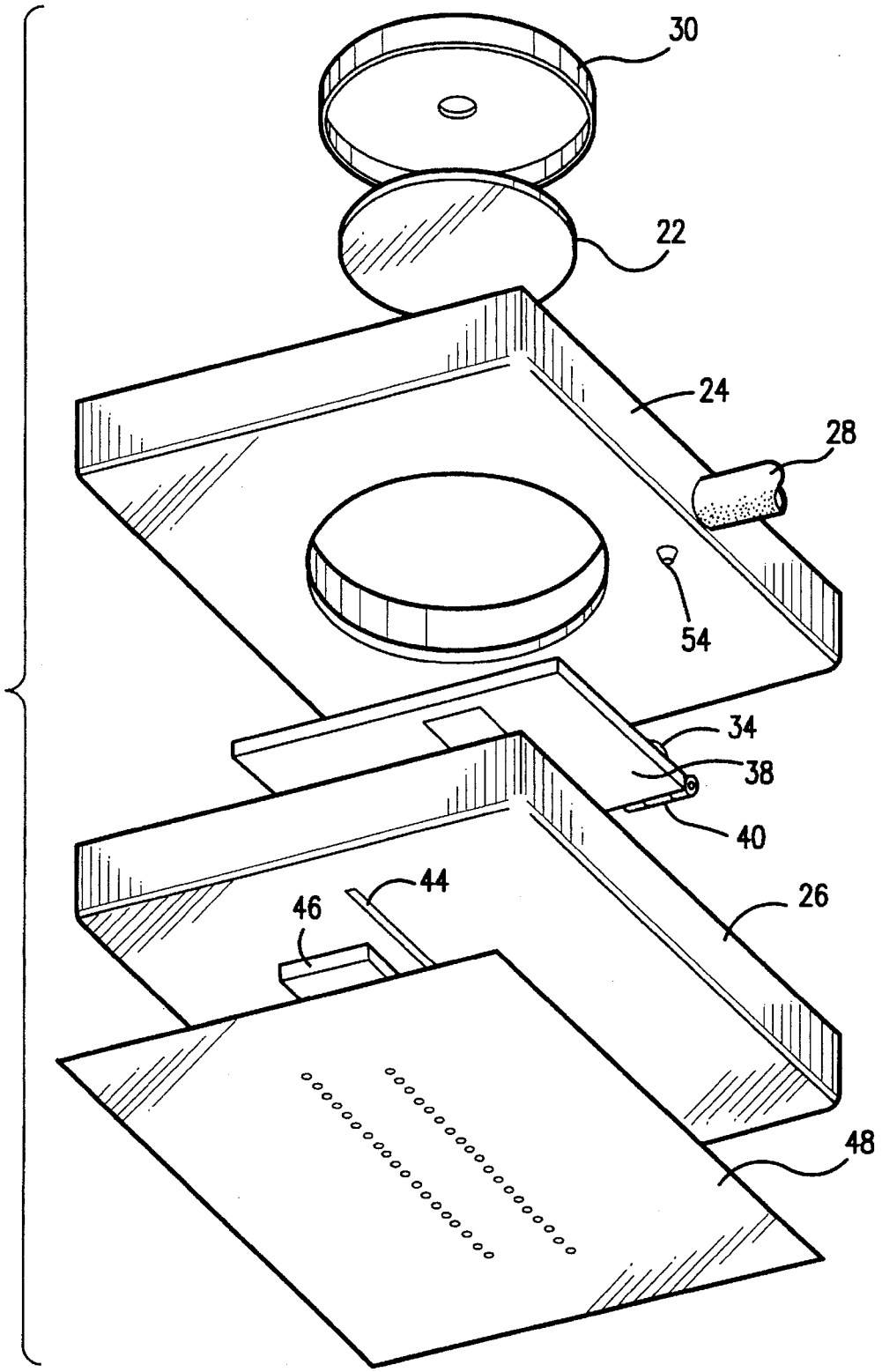
Figure 3A:
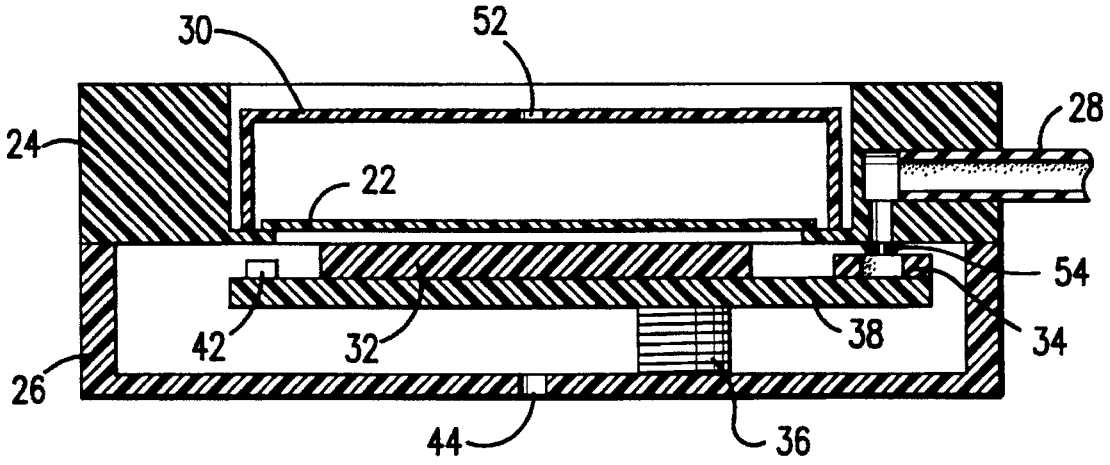
FIGS. 3A, 3B and 3C show the nozzle and valve seat of the back pressure regulator shown in FIGS. 1, 2A, and 2B.

The print head assembly 112, FIG. 1, generally comprises a back pressure regulator 20 illustrated in FIGS. 2A, 2B and 3A and an ink-jet printhead 46 and associated nozzle plate 48 illustrated in FIG. 2A. The pressure regulator 20 receives pressurized ink from the reservoir and delivers the ink to the printhead at a pressure of about two to three inches of water below atmospheric pressure. The printhead (not shown in FIG. 1 ) is illustrated ejecting droplets 115 of ink onto a printing medium 116 such as paper.

The print head assembly 112 is releasibly retained in a movable carriage 136. The movable carriage slides laterally along a guide rail 137. The guide rail is rigidly mounted in the printer. The movable carriage is translated laterally by a drive motor 138, pulley 140 and connecting drive belt 141. The drive motor causes the print head assembly 112 to move laterally across the print medium 116 one swath at a time. At the completion of each swath the print medium is stepped forward by two paper feed rollers 143 so that the swaths are laid down on the print medium one after the other in a line by line manner.

FIGS. 2A and B show a top view of the preferred embodiment of a miniature, lightweight, back pressure regulator 20 for ink-jet printheads, that fits inside a print cartridge and maintains a constant back pressure over the full range of printer output speeds, the full range of changes in printer output speeds, the full range of print densities, the full range of changes in print densities, and the full range of ink reservoir pressures. FIGS. 2A and B show a diaphragm 22, a top case 24, a bottom case 2628. In t ink reservoir hose 28. In the preferred embodiment of the invention, the total dimensions of the regulator are less than 0.6"×0.8"×0.2". Versions as small as 0.3"×0.3"×0.1", and possibly smaller, can be built. A back pressure regulator for ink-jet printheads with other dimensions would not depart from the scope of the invention.

FIGS. 2A and 2B show exploded views from two different angles of back pressure regulator 20. The separation of top case 24 and bottom case 26 reveals a lever 38 with a hinge 40 that supports a diaphragm piston 32, and a valve seat 34. The alignment of valve seat 34 allows it to shut-off the flow of ink through a nozzle 54 that receives ink from ink reservoir hose 28. (See FIG. 3A.) Diaphragm 22 and the ink inside nozzle 54 push down on lever 38 and push valve seat 34 away from nozzle 54. A spring 36 inside bottom case 26 pushes lever 38 upward and pushes valve seat 34 toward nozzle 54. In the preferred embodiment of the invention, back pressure regulator 20 attaches to an ink-jet printhead 46 and ink travels from bottom case 26 to ink-jet printhead 46 through an ink feed slot 44.

The preferred embodiment of back pressure regulator 20 controls the back pressure of printhead 46 by controlling the flow of ink into printhead 46 from an off-axis ink reservoir that attaches to regulator 20 through ink reservoir hose 28. Normally, the flow of ink into printhead 46 is shut-off. When the back pressure of ink-jet printhead 46 is less then the set-point back pressure, which is −2" of water in the preferred embodiment, diaphragm 22 exerts a downward force on diaphragm piston 32 that exceeds the upward force of spring 36 and causes diaphragm piston 32, lever 38, and valve seat 34 to rotate downward. When valve seat 34 rotates downward, it moves away from nozzle 54 and allows ink to flow through it and into bottom case 26. When the back pressure of ink-jet printhead 46 exceeds the set-point pressure, the magnitude of the force exerted by spring 36 exceeds the magnitude of the force exerted by diaphragm 22 and the ink in nozzle 54. This causes valve seat 34 to rotate upward and shut-off the flow of ink through nozzle 54.

Diaphragm cover 30 protects diaphragm 22. A priming hole 52 through diaphragm cover 30 permits one to prime regulator 20 by blowing air onto diaphragm 22 to deflect it and allows air to flow freely to the diaphragm. Lever stand-offs 42 keep lever 38 off the case.

Diaphragm cover 30, top case 24, bottom case 26, diaphragm piston 32, lever 38, and nozzle 34 are made from inexpensive, lightweight materials (e.g., thermoplastics) that are compatible with ink-jet printer inks via an inexpensive manufacturing process (e.g., injection molding). The combined weight of lever 38 and diaphragm piston 32 is ideally less than 10% of the maximum diaphragm force. Ideally, the lever/diaphragm piston combination has neutral buoyancy in ink to minimize orientation dependent forces from weight or buoyancy. Valve seat 34 is made of soft elastic material (e.g., silicone rubber) so that it will form a leak-free seal with nozzle 54. Spring 36 would be best constructed of stainless steel or molded plastic.

FIG. 3A shows a cross-section of back pressure regulator 20, including nozzle 54, and valve seat 34. In FIG. 3A, valve seat 34 has shut-off the flow of ink from nozzle 54. When diaphragm 22 causes lever 38 to rotate, valve seat 34 moves away from nozzle 54 and ink flows into bottom case 26 and through ink slot 44 into printhead 46. One advantage of the present invention is that the valve seat does not encounter any sliding friction when moving. This allows valve seat 34 respond to small changes in the back pressure. Additionally, there is no sliding friction anywhere in the pressure regulator design. This has the advantage of minimizing unpredictable forces that would degrade accurate pressure regulation. (FIGS. 1,2, and 3A show a regulator with a downstream valve (i.e., the nozzle is on the high pressure side), pressure regulators can be made with upstream nozzles, such as that shown in FIG. 9 or nozzles with sliding valve seats. The scope of the invention includes any type of mechanism that can shut-off the flow of ink. The claims and the specification use the words nozzle and valve seat for purposes of illustration and not for purposes of limitation. The term nozzle includes ink conduits of any shape and valve seat includes any type of device that can shut-off the flow of ink through an ink conduit.)

The force exerted by spring 36, $F_s$, pushes upward on lever 38 and the force exerted by diaphragm 22, $F_{Dia}$, the force exerted by the ink in nozzle 54, $F_{Nozz}$, and the sealing force of the valve, $F_{Seal}$, push downward on lever 38. (The terms upward and downward are used for convenience only, the pressure regulator can function in any orientation.) At the set-point back pressure, the magnitude of the force exerted by diaphragm 22 plus the magnitude of the force exerted by ink inside nozzle 54 plus the sealing force equal the magnitude of the force exerted by spring 36:

$$F_s = F_{Dia} + F_{Nozz} + F_{Seal}. \quad (1)$$

As long as the $F_s$ exceeds $F_{Dia}$ plus $F_{Nozz}$ plus $F_{Seal}$, the valve remains closed. When the back pressure equals the set-point back pressure, valve seat 34 touches nozzle 54 but it does not exert any force on it. When the back pressure decreases again, then $F_s < F_{Dia} + F_{Nozz} + F_{Seal}$, and valve seat 34 moves away from nozzle 54 and ink flows into bottom case 26.

In an off-axis ink reservoir system, the ink reservoir generally must be pressurized to propel ink to regulator 20 and through nozzle 54. If the pressure of the ink reservoir is unregulated, like in the preferred embodiment, the pressure of the ink in nozzle 54 will vary with the ink volume in the ink reservoir. Sometimes, this pressure may vary from approximately 15 psi to slightly above 0 psi.

The force exerted by ink in nozzle 54 equals:

$$F_{Nozz}=\left(\frac{\pi D_{Nozz}^2}{4}\right)P_{SI}, \tag{2}$$

where $D_{Nozz}$ equals the inner diameter of nozzle 54 and $P_{si}$ equals the pressure of the ink in nozzle 54. As the ink reservoir pressure varies, the force exerted by the ink in nozzle 54 will vary. This pressure variation can cause the valve (i.e., valve seat 34 and nozzle 54) to open at a back pressure other than the set-point pressure if the magnitude of $F_{Nozz}$ is close to the magnitude of the force exerted by diaphragm 22 at the set-point back pressure. To prevent this, the force exerted by diaphragm 22 at the set-point back pressure must be much greater than the maximum force of the ink inside nozzle 54. In the preferred embodiment of the invention, the force exerted by the diaphragm, $F_{Dia}$, at the set-point pressure should be at least five times larger than the maximum force of the ink inside nozzle 54 (when the leverage is one) to provide good sealing under all conditions. This force multiple is known as the "overforce ratio". High overforce ratios result in accurate pressure regulation and thereby a constant back pressure. The back pressure will equal the set-point back pressure plus an offset, $P_{SPP}\pm(P_{SPP}/O_F)$. For the preferred embodiment, $O_F=50$ and $P_{SPP}=-2"$ so the back pressure would remain approximately constant, more precisely it would equal $-2"\pm0.04"$. However, $O_F$ can be as low as 5.

Figure 3B:
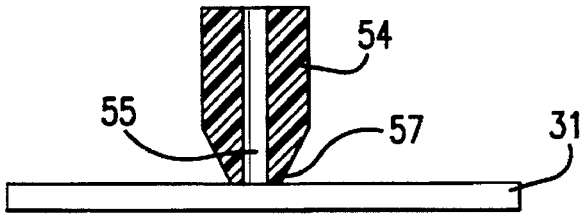
Figure 3C:
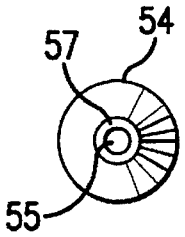

FIG. 3B shows that nozzle 54 has a taper to a small outer radius to maximize the sealing pressures. Preferably, the area of seal 57, shown in FIG. 3C, should be less than one half the area of bore 55 of nozzle 54. (Note: The relative dimensions of seal 57 and bore 55 in FIG. 3B and 3C are inaccurate.)

Spring 36, shown in FIGS. 2A and 2B, exerts a force on lever 38 that equals the force exerted by diaphragm 22 when the back pressure equals the set-point back pressure. If the set-point back pressure equals minus 2" of water, then the force exerted by spring 36 equals the product of minus 2" of water and the area of diaphragm 22. This calculation assumes an overforce ratio of greater than 20 so that the force of the ink in nozzle 54 is negligible.

A pre-load deflection of spring 36 creates the force exerted by spring 36 when valve seat 34 sits on nozzle 54. When diaphragm 22 pushes valve seat 34 away from nozzle 54, the deflection of spring 36 increases and the force exerted by spring 36 increases. To make pressure regulator 20 very sensitive to slight changes in back pressure, the pre-load deflection of spring 36 should be much greater than the additional deflection of spring 36 when the valve seat 34 moves away from nozzle 54. Valve seat 34 should move far enough away from nozzle 54 to allow the maximum flow rate of the ink stream (i.e., the maximum flow rate occurs during black-out printing) to pass through nozzle 54. Generally, this distance exceeds the radius of nozzle 54. When the back pressure goes slightly below the set-point back pressure, such as minus 2.1", valve seat 34 moves far enough away from nozzle 54 to allow the nozzle 54 carry the maximum flow rate of the ink stream.

When the ink-jet printer is not operating, the pressure of the ink inside ink-jet printhead 46 will be at $-2"$ and diaphragm 22 will not deflect. The entire force of spring 36 will push valve seat 34 against nozzle 54. As described in a previous paragraph, this force equals the force exerted by diaphragm 22 at the set-point back pressure and it is typically at least five (fifty in the preferred embodiment) times the maximum force exerted by the ink stream in nozzle 54. The large overforce ratio between the spring and the ink stream in nozzle 54 will prevent the pressure regulator from leaking when the printer is turned-off.

The overforce requirement and the large difference between the ink reservoir pressure and the back pressure cause diaphragm 22 to be relatively large. In the preferred embodiment of the invention, the set-point back pressure is $-2"$ of water and the pressure of ink inside nozzle 54 may be two psi or 54 inches of water and it could be much higher. If the force generated by diaphragm 22 were applied directly to the valve seat, the size of the diaphragm that the $-2"$ of water acts on must be very large to generate a force that is 20 to 40 times larger than the force created by the 54" of water in nozzle 54.

Diaphragm 22 is the largest item in regulator 20 and it determines the size of the preferred embodiment of the invention. One way to decrease the size of diaphragm 22 while maintaining an overforce ratio greater than 20 is to decrease the inner diameter of nozzle 54. However, the inner diameter of nozzle 54 must be large enough to pass enough ink under the most extreme conditions. This occurs when the ink stream flow rate equals the maximum flow rate and the ink reservoir pressure is at its minimum. The maximum flow rate occurs during black-out printing mode (i.e., the printer covers the page with ink by ejecting the maximum number of drops). The equation derived below gives the inner diameter of nozzle 54 as a function of the pressure drop across it and the ink flow. Flow through nozzle 54 is limited primarily by the kinetic pressure drop, but the term that covers viscous friction drop is included.

$$\Delta p_{total}=\Delta p_{kinetic}+\Delta p_{viscous\ friction} \tag{3}$$

where $\Delta p_{total}$ is the pressure drop across nozzle 54. The kinetic pressure drop term is:

$$\Delta p_{kinetic}=\rho v^{22}/2 \tag{4}$$

where ρ is the density of the ink and v is the mean flow velocity of the ink further defined below as the volumetric flow rate divided by the cross-sectional area of nozzle 54:

$$v=\frac{Q*4}{\pi D_{nozz}^2}. \tag{5}$$

Hence, $$\Delta p_{kinetic}=\frac{8}{\pi^2}\ \frac{\rho Q^2}{D_{nozz}^4}. \tag{6}$$

Poisuelle resistance law defines the pressure drop due to viscous friction. Where L is length of nozzle 54 and μ is the ink viscosity:

$$\Delta P_{friction}=\frac{32\mu Lv}{D_{nozz}^2}; \tag{7}$$

$$\Delta P_{friction}=\frac{32\mu L}{D_{Nozz}^2}\left(\frac{Q*4}{D_{Nozz}^2\pi}\right)=\frac{128}{\pi}\ \frac{\mu LQ}{D_{Nozz}^4}. \tag{8}$$

Therefore, $$\Delta P_{Total}=\left(\frac{128}{\pi}\ \mu LQ+\frac{8}{\pi^2}\ \rho Q^2\right)\left(\frac{1}{D_{Nozz}^4}\right). \tag{9}$$

Consequently, $$D_{Nozz}^4=\left(\frac{128}{\pi}\ \mu LQ+\frac{8}{\pi^2}\ \rho Q^2\right)\left(\frac{1}{\Delta P_{TOTAL}}\right). \tag{10}$$

To calculate the minimum inner diameter of nozzle 54, set Q equal to the maximum volumetric flow rate, $Q_{Max}$, and set $\Delta P_{Total}$ equal to the minimum pressure drop across nozzle 54, that equals the minimum pressure of the ink in nozzle 54, $P_{si.low}$ plus the set-point back pressure, $P_{si.low}+P_{SPP}$. So, the minimum inner diameter of nozzle, $D_{Nozz.min}$, is:

$$D_{Nozz.min}=\left(\left(\frac{128}{\pi}\mu L Q_{Max}+\frac{8}{\pi^2}\rho Q_{Max}^2\right)\left(\frac{1}{P_{si.low}+P_{SPP}}\right)\right)^{1/4}. \quad (11)$$

The maximum force that the ink inside the nozzle 54 can generate is:

$$F_{Nozz.Max}=\left(\frac{\pi D_{Nozz}^2}{4}\right)P_{SI.HI} \quad (12)$$

where $P_{Si.HI}$ is the maximum pressure inside nozzle 54. The force exerted by diaphragm 22 times the leverage factor $L_{ev}$ must equal $F_{Nozz.Max}$ times $O_F$, the overforce, as shown below:

$$\left(\frac{\pi D_{dia}^2}{4}\right)*P_{SPP}*L_{ev}=O_F*\left(\frac{\pi D_{Nozz}^2}{4}\right)P_{SI.HI} \quad (13)$$

where $D_{Dia}$ is the diameter of the diaphragm, $L_{ev}$ is the leverage of the diaphragm, and $P_{SPP}$ is the set-point back pressure.

To obtain the minimum diameter of the diaphragm, solve equation (13) for $D_{Dia}$, substitute $D_{Nozz.min}$ defined by equation (11) for the variable $D_{Nozz}$ and substitute values of $O_F$, $P_{SI.HI}$, $L_{ev}$, and $P_{SPP}$ chosen for the preferred embodiment. The resulting equation is:

$$D_{Dia.Min}=\left(\frac{O_F*P_{SI.HI}}{P_{SPP}L_{ev}}\right)^{1/2}\left(\left(\frac{128}{\pi}\mu L Q_{Max}+\frac{8}{\pi^2}\rho Q_{Max}^2\right)\left(\frac{1}{P_{si.low}+P_{SPP}}\right)\right)^{1/4}. \quad (14)$$

Another way to decrease the size of diaphragm 22 is to use lever 38 or any other device that provides a mechanical advantage—including cams and linkages. The higher the mechanical advantage, the beer, as long as the resulting device is consistent with the tolerances of the system.

Figure 4:
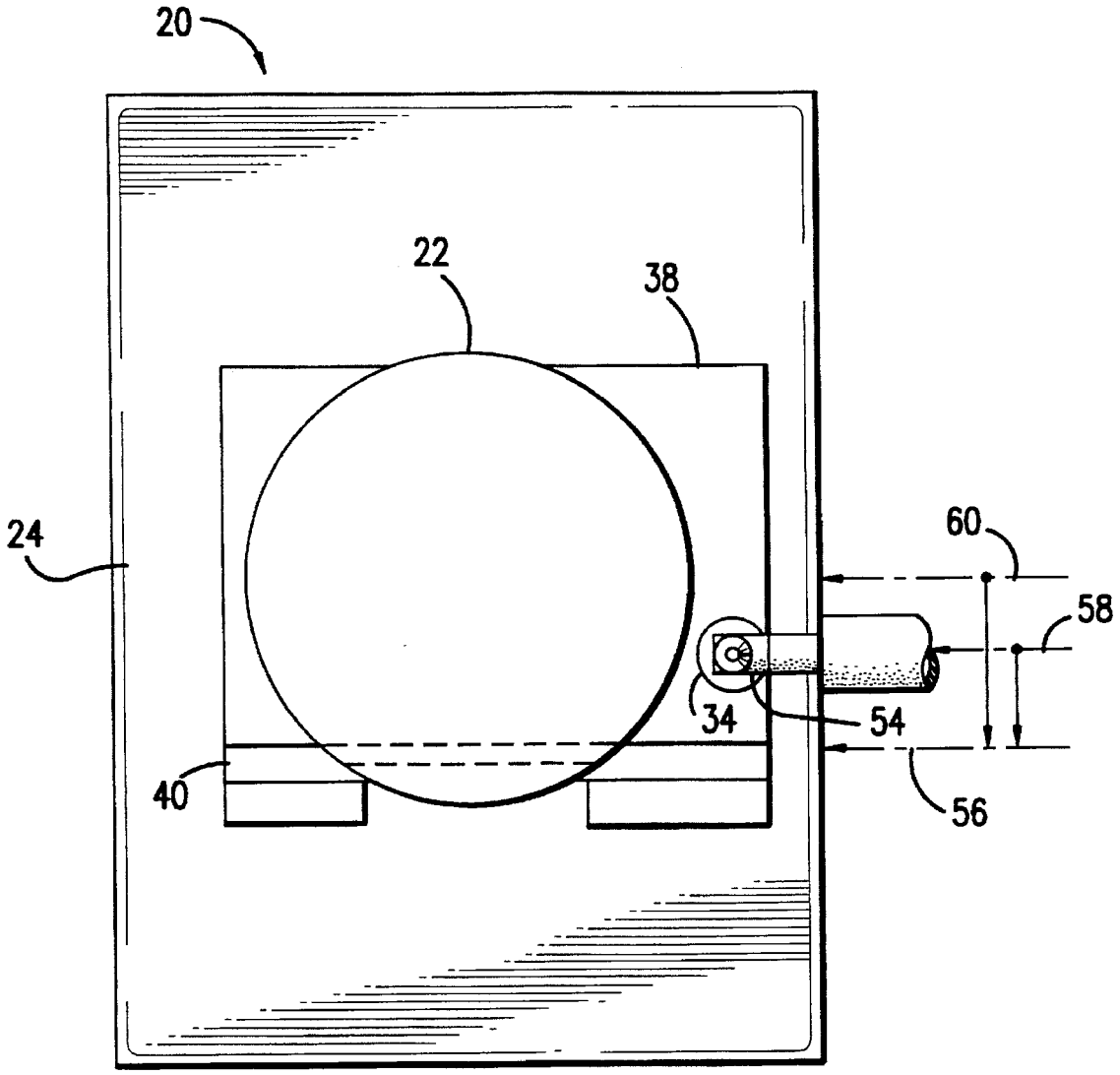
FIG. 4 shows the hinge, diaphragm moment, and nozzle moment of the preferred embodiment of the back pressure regulator.

FIG. 4 is a top view of pressure regulator 20 and shows the relative position of a hinge line 56, a valve seat moment arm 58, and a diaphragm moment arm 60. The diaphragm moment arm 60 is greater than valve seat moment arm 58 so the force of diaphragm 22 on valve seat 54 has a leverage greater than one. Increasing the length of lever 38 has the advantage of decreasing the size requirement of diaphragm 22. The various embodiments discussed in this application have leverage ratios between 1 and 5, but other ratios, such as 0.5, and other configurations of lever 38 are possible and do not depart from the scope of the invention. Also, FIG. 4 shows that the direction of printhead motion and acceleration 62 is parallel to the axis of hinge 40 and parallel to a perpendicular of a perpendicular of top surface of lever 38.

Figure 5:
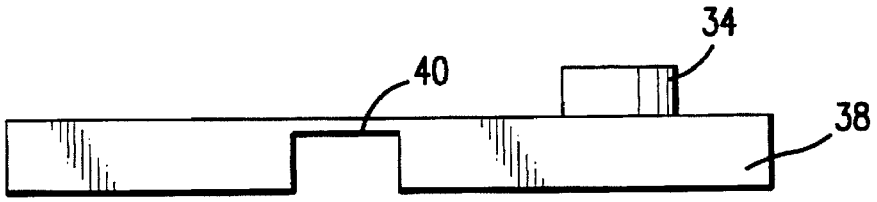
FIG. 5 shows the hinge shown in FIGS. 2A, 2B, and 4.

FIG. 5 shows flexure hinge 40 formed by milling a grove in lever 38. Flexure hinge 40 has the advantage of bending with minimal friction without twisting. If hinge 40 of lever 38 twists, then lever 38 twists and valve seat 34 does not align with nozzle 54 in a manner to seal it with the maximum force. The flexure hinge is elastic and the scope of the invention includes using the elastic forces in the hinge as the spring force that pushes the valve seat against the nozzle. The scope of the invention includes other low friction hinges such as rolling hinges and cone and point hinges.

FIG. 11 is a sample of print produced by a printer using a pressure regulator with the following specifications: the diameter of diaphragm 22, $D_{Dia}$, equals 0.625"; the diameter of the diaphragm piston is 0.5"; the leverage, $L_{ev}$, equals 3; the overforce, $O_F$, equals 42 at the maximum supply pressure; the inner diameter of nozzle 54, $D_{Nozz}$, equals 20 mils; the maximum flow of the ink, $Q_{Max}$ is 0.2 cc/sec.; the length of nozzle 54, L, equals 0.05"; the ink viscosity, μ equals 0.03 poise; and the density of the ink, ρ, equals 1 gm/cc. The ink reservoir pressure varies between 0 and 2 psi and the set-point back pressure equals −2" of water.

In an alternate embodiment of the pressure regulator, the diameter of diaphragm 22, $D_{Dia}$, equals 0.375", the diameter of the diaphragm piston is 0.3", the leverage, $L_{ev}$, equals 3, the overforce, $O_F$, equals 108 at the maximum ink reservoir pressure of 2.5 psi, the maximum flow of the ink, $Q_{Max}$, is 0.2 cc/sec., the inner diameter of nozzle 54, $D_{Nozz}$, equals 12 mils, the length of nozzle 54, L, equals 0.05", the ink viscosity equals 0.03 poise; the density of the ink, ρ, equals 1 gm/cc; and the minimum supply pressure is 0.5 psi.

The tables below give alternate design parameters. The parameters of Table 1 are the reference case and each of Tables 2–5 vary only one of these parameters. Also, Tables 1–5 below give the inner diameter of the nozzle, $D_{Nozz}$, for each value of $P_{SI.LOW}$. For Table 1, the maximum pressure in nozzle 54, $P_{SI.HI}$, is 2.5 psi; the overforce, $O_F$, at $P_{SI.Hi}$ equals 50; the set-point back pressure, $P_{SPP}$, equals −2" of water; the maximum flow of the ink, $Q_{Max}$, is 0.2 cc/sec.; the length of nozzle 54, L, equals 0.05"; the ink viscosity equals 0.03 poise; and the density of the ink, ρ, equals 1 gm/cc.

TABLE 1

OF DIAPHRAGM DIAMETERS (Inches)

| | $P_{SI.LOW}$ | | | | | | |
|---|---|---|---|---|---|---|---|
| $L_{ev}$ | 0 psi | .25 psi | .5 psi | .75 psi | 1 psi | 2 psi | 2.5 psi |
| 1 | .91 | .63 | .55 | .50 | .47 | .40 | .38 |
| 2 | .64 | .45 | .39 | .36 | .33 | .28 | .27 |
| 3 | .53 | .37 | .32 | .29 | .27 | .23 | .22 |
| 4 | .45 | .32 | .27 | .25 | .24 | .20 | .19 |
| 5 | .41 | .28 | .25 | .22 | .21 | .18 | .17 |
| $D_{Nozz}$ | .023 | .016 | .014 | .013 | .012 | .010 | .010 |

Table 2 gives the diameter of diaphragm, $D_{Dia}$, (in inches) as a function of Leverage, $L_{ev}$, and $P_{SI.LOW}$ when the set-point back pressure is changed from −2" of water to −3" of water and all other parameters remain the same.

TABLE 2

OF DIAPHRAGM DIAMETERS (Inches)

| | $P_{SI.LOW}$ | | | | | | |
|---|---|---|---|---|---|---|---|
| $L_{ev}$ | 0 psi | .25 psi | .5 psi | .75 psi | 1 psi | 2 psi | 2.5 psi |
| 1 | .67 | .50 | .44 | .41 | .38 | .32 | .31 |
| 2 | .47 | .36 | .31 | .29 | .27 | .23 | .22 |
| 3 | .39 | .29 | .25 | .23 | .22 | .19 | .18 |
| 4 | .34 | .25 | .22 | .20 | .19 | .16 | .15 |
| 5 | .30 | .22 | .20 | .18 | .17 | .15 | .14 |
| $D_{Nozz}$ | .021 | .01 | .014 | .013 | .012 | .010 | .010 |

Table 3 gives the diameter of diaphragm, $D_{Dia}$, (in inches) as a function of Leverage, $L_{ev}$, and $P_{SI.LOW}$ when the set-point back pressure is changed back to −2" of water, the viscosity is changed from 0.03 poise to 0.01 poise, and all other parameters remain the same.

TABLE 3

OF DIAPHRAGM DIAMETERS (inches)

| | $P_{si.low}$ | | | | | | |
|---|---|---|---|---|---|---|---|
| $L_{ev}$ | 0 psi | .25 psi | .5 psi | .75 psi | 1 psi | 2 psi | 2.5 psi |
| 1 | .82 | .57 | .49 | .45 | .42 | .36 | .34 |
| 2 | .58 | .40 | .35 | .32 | .30 | .25 | .24 |
| 3 | .47 | .33 | .29 | .26 | .24 | .21 | .20 |
| 4 | .41 | .28 | .25 | .23 | .21 | .18 | .17 |
| 5 | .37 | .25 | .22 | .20 | .19 | .16 | .15 |
| $P_{si.low}$ | .021 | .015 | .013 | .012 | .011 | .009 | .009 |

Table 4 gives the diameter of diaphragm, $D_{Dia}$, (in inches) as a function of Leverage, $L_{ev}$, and $P_{Sl.LOW}$ when the viscosity is changed back to 0.03 poise and the length of the nozzle is changed from 0.05" to 0.1" and all other parameters remain unchanged.

TABLE 4

OF DIAPHRAGM DIAMETER (Inches)

| | $P_{SLLOW}$ | | | | | | |
|---|---|---|---|---|---|---|---|
| $L_{ev}$ | 0 psi | .25 psi | .5 psi | .75 psi | 1 psi | 2 psi | 2.5 psi |
| 1 | 1.01 | .70 | .61 | .56 | .52 | .44 | .42 |
| 2 | .71 | .50 | .43 | .39 | .37 | .31 | .30 |
| 3 | .58 | .41 | .35 | .32 | .30 | .26 | .24 |
| 4 | .50 | .35 | .31 | .28 | .26 | .22 | .21 |
| 5 | .45 | .31 | .27 | .25 | .23 | .20 | .19 |
| $D_{Nozz}$ | .026 | .018 | .016 | .014 | .013 | .011 | .011 |

Table 5 gives the diameter of diaphragm, $D_{Dia}$, (in inches) as a function of Leverage, $L_{ev}$, and $P_{Sl.LOW}$ when the length of the nozzle is changed back to 0.05" and the volumetric flow rate is changed from 0.2 cc/sec to 0.02 cc/sec and all other parameters remain unchanged.

TABLE 5

OF DIAPHRAGM DIAMETERS (Inches)

| | $P_{SLLOW}$ | | | | | | |
|---|---|---|---|---|---|---|---|
| $L_{ev}$ | 0 psi | .25 psi | .5 psi | .75 psi | 1 psi | 2 psi | 2.5 psi |
| 1 | .44 | .31 | .27 | .25 | .23 | .19 | .18 |
| 2 | .31 | .22 | .19 | .17 | .16 | .14 | .13 |
| 3 | .26 | .18 | .15 | .14 | .13 | .11 | .11 |
| 4 | .22 | .15 | .13 | .12 | .11 | .10 | .09 |
| 5 | .20 | .14 | .12 | .11 | .10 | .09 | .08 |
| $D_{Nozz}$ | .011 | .008 | .007 | .006 | .006 | .005 | .005 |

Diaphragm 22 should be attached to top case 24 so that it is limp. If the material stretches, the tension in diaphragm 22 will reduce the amount of deflection. The material could be clamped, glued, plastic welded, or attached any other way to physically hold it in place.

The deflection of an elastic diaphragm 22 at 0 initial tension can be calculated from:

$$\text{pressure} = \frac{(E * (\text{deflection})^3 * \text{thickness})}{(\text{radius})^4} \quad (15)$$

where pressure is the pressure difference across diaphragm 22, E is the modulus of elasticity of the diaphragm material, thickness is the thickness of the diaphragm material, and radius is that of diaphragm 22. The maximum deflection of diaphragm 22 occurs when the back pressure equals the set point back pressure and the pressure difference across diaphragm 22 equals the set-point back pressure—atmospheric pressure. If the radius of diaphragm 22 does not change, thickness and E will be that of the chosen diaphragm material. In the preferred embodiment, diaphragm 22 has a large deflection because the greater the deflection the higher the leverage can be for a given tolerance in the hinge, valve seat, and lever thickness and play.

Alternate embodiments of diaphragm 22 made from slack (e.g., corrugated), inelastic plastic film do not obey equation (15) and the entire force applied to these diaphragms transfers to lever 38. These inelastic diaphragms deflect but do not stretch to move lever 38. An advantage of plastic diaphragms over rubber diaphragms is their ability to remain chemically inert in the presence of ink.

Figure 6A:
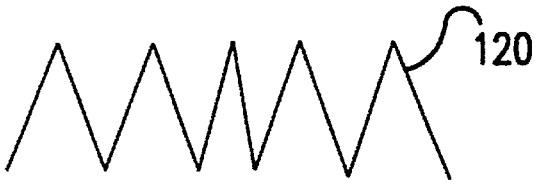
FIGS. 6A and 6B show an alternate embodiment of the diaphragm that allows more flexibility and greater motion.
Figure 6B:
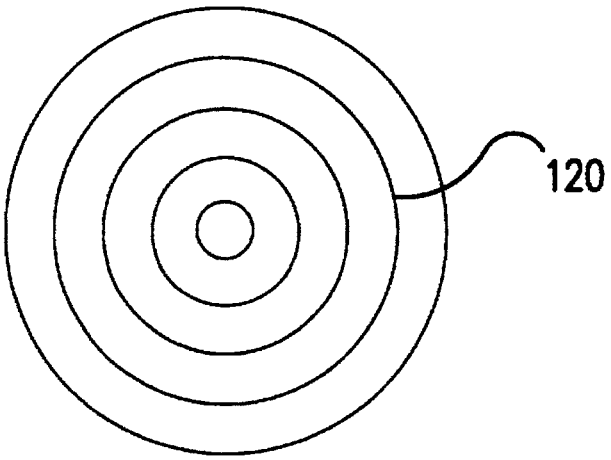
Figure 7:
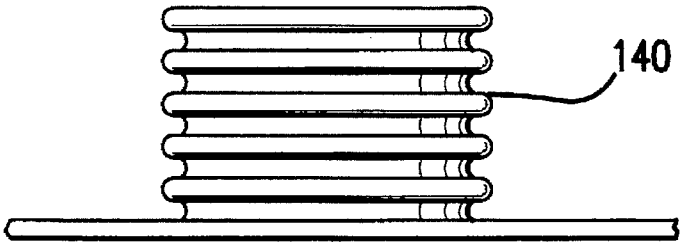
FIG. 7 shows another alternate embodiment of the diaphragm.

FIG. 6A is a side view of an alternate embodiment of the diaphragm that has a corrugated cross section and is flexible. FIG. 6B is a top view of diaphragm 120 shown in FIG. 6A. FIG. 7 shows another alternate embodiment, a bellows diaphragm 140. Ideally, corrugated diaphragm 120 and bellows diaphragm 140 have very little deflection resistance and enough deflection to move lever 38 (or any other device providing mechanical advantage) so that valve seat 34, shown in FIG. 2A, can move from strongly seated to nozzle 54 in FIG. 2B to one nozzle radius away from nozzle 54 so that valve seat 34 will not impede the flow of ink from nozzle 54.

Figure 8A:
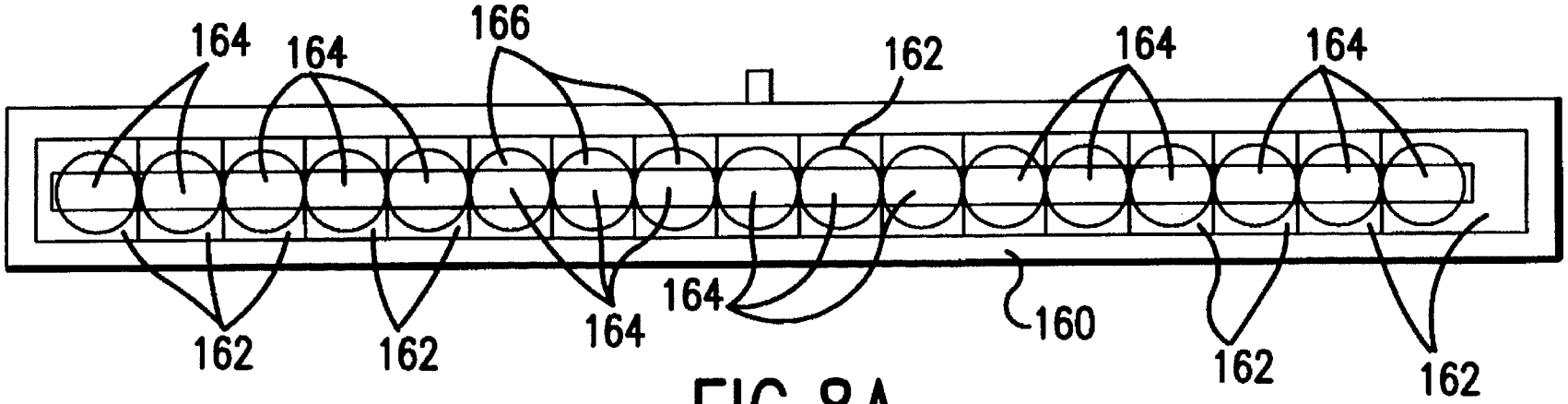
FIG. 8A is a top view of a page wide print cartridge with numerous ink-jet printheads and pressure regulators and 8B is a top view of a two-color print cartridge and a print cartridge that prints with multi-component inks.
Figure 8B:
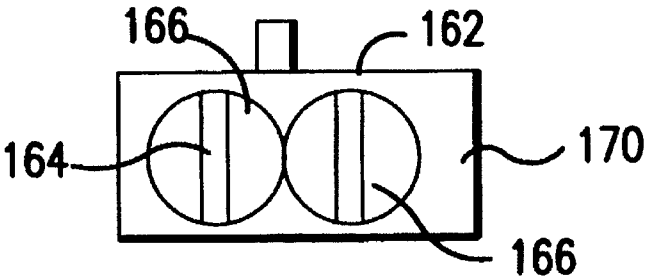

FIG. 8A shows a page-wide print cartridge 160 that has numerous ink-jets printheads 164 positioned across it. FIG. 8B shows a print cartridge 170 for printing with multiple component inks or inks of two different colors. (Alternate embodiments of the print cartridge could include more printheads and pressure regulators for printing with more colors or inks with more components.) In both of these print cartridges, each ink-jet printhead 164 has a pressure regulator 162 associated with it. This configuration allows print cartridge 160, 170 to be tilted at any angle because the numerous pressure regulators 162 prevent long columns of ink from forming that cause the back pressure of the various ink-jet printheads 164 to vary with their position on print cartridge 160, 170. If there is a pressure regulator 162 every inch, then the print cartridge 160 could print when vertical.

Another advantage of having a pressure regulator 162 for each ink-jet printhead 164 is that one or more printheads can be replaced without the necessity of purging ink from the system and then refilling the system with ink after the printhead 164 is replaced. Pressure regulator 162 will shut-off the flow of ink from nozzle 54, shown in FIG. 2B, when printhead 164 is removed because instead of a back pressure forcing a diaphragm 166 to deflect, there will be atmospheric pressure. Diaphragm 166 will not deflect at all and the entire force of spring 36 in FIG. 2A will force valve seat 34 against nozzle 54.

Figure 9:
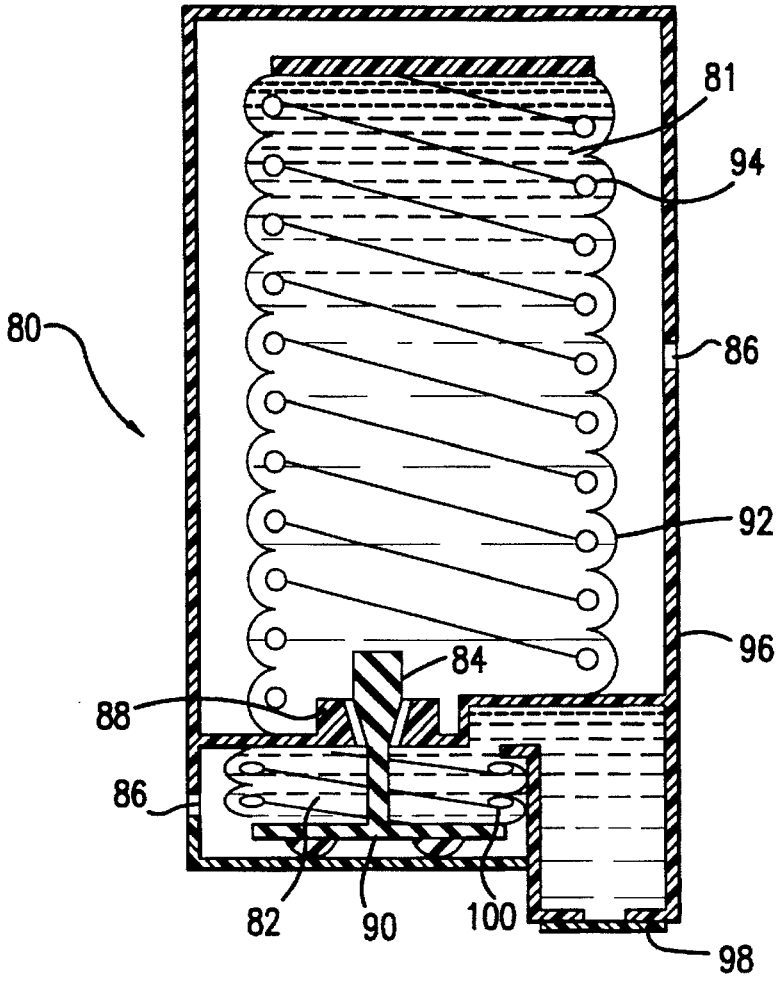
FIG. 9 shows an alternate embodiment of the back pressure regulator with an upstream nozzle and an onboard ink reservoir.

FIG. 9 shows an alternate embodiment of the invention that is a pressure regulator 80 with an upstream nozzle 88 located in a print cartridge 96 having an onboard ink reservoir enclosed in ink bladders 92, 100. A vent 86 exposes one side of a diaphragm/base 90 to atmospheric pressure. The other side of diaphragm/base 90 is exposed to the back pressure of ink-jet printhead 98. Spring 82 is set to allow a valve stem 84 to move away from a nozzle 88 when the back pressure of inkjet printhead 98 is less than the set-point back pressure (e.g., −2" of water). When the back pressure of ink-jet printhead 98 is less than the set-point pressure, diaphragm/base 90 exerts a force that overcomes the force exerted by spring 82 and pushes valve stem 84 away from nozzle 88 which allows fluid to flow from bladder 92 to bladder 100 of ink-jet printhead 98 and raise the back pressure of printhead 98. The scope of the invention includes embodiments with a lever or other means for mechanical advantage if a smaller diaphragm is desired.

Upstream valves have the advantage that the force exerted by the ink reservoir on the valve stem forces the valve stem against the nozzle and helps to prevent leaks. With downstream valves the force exerted by the ink reservoir on the valve seat pushes the valve seat away from the nozzle and causes the valve to leak. The advantage of downstream valves over upstream valves is that they operate more smoothly and do not chatter.

Figure 10:
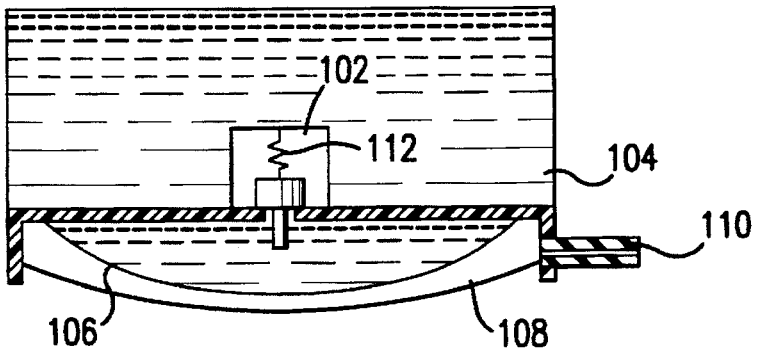
FIG. 10 shows a check valve installed at the ink reservoir with an upstream nozzle.

FIG. 10 shows an upstream check valve 102 installed in an offboard ink reservoir 104. Offboard ink reservoir 104 uses check valve 102 and a spring bag made up of a spring 106 and a bag 108 to control the back pressure of an ink-jet printhead that is not shown but connects to ink reservoir 104 through hose 110. The system appears almost identical in form and function to the spring bags currently used in ink-jet printhead cartridges, the difference being that the spring bag 106/108 is used with a check valve 102 that monitors the level of the back pressure. This check valve does not regulate pressure; it subtracts pressure from a reference.

At the start of ink extraction, spring bag 106/108 provides the necessary back pressure. As ink is extracted the back pressure decreases and spring 106 compresses and activates check valve 102. When check valve 102 is activated, ink at ambient pressure flows into spring bag 106, 108 until the pressure drop across check valve 102 equals the set-point which occurs when the back pressure equals –2" of water in the preferred embodiment. An advantage of this system is the much higher sealing force of upstream check valve 102. Since check valve 102 is in the ink reservoir instead of inside the printhead, the spring bag 106/108 can be very large and thereby generate a large force when the back pressure goes below the set-point pressure. Since spring bag 106/108 can generate a large force, the force sealing check valve 102 can also be very large. To open upstream check valve 102, the surface area of the spring bag 106/108 in the preferred embodiment is 60×60 mm. At a –3" of back pressure, this geometry would provide 0.6 lbs of force to open check valve 102.

In alternate embodiments, the pressures may vary dramatically from the above pressures without departing from the scope of the invention. For example, the set-point back pressure could be anywhere from 0" of water to minus 7 inches of water and the ink reservoir pressure could be anywhere between –0.1 psi to over +30 psi and experience transient pressure of 120 psi.

Although the reservoir 110, FIG. 1 is disclosed as using a piston 119 and a spring 120 to pressurize the ink, other pressurizing systems for liquids can be used. For example, compressed air from a second reservoir, a peristaltic, piston, or IMO pump, and other spring configurations are contemplated.

Although specific embodiments of the invention have been described and illustrated, the invention is not be limited to the specific forms or arrangement of parts so described and illustrated herein. The invention is limited only by the claims.

We claim:

1. Apparatus for providing ink to a printhead, comprising:

a) a reservoir for containing ink at a reservoir pressure;

b) a pressure regulator for receiving ink from the reservoir and for delivering ink to a printhead at a gauge pressure; and c) an ink conduit connected between the reservoir and the pressure regulator for delivering ink thereto, said reservoir and pressure regulator having a difference in elevation resulting in a hydrostatic pressure so that the reservoir pressure and the hydrostatic pressure are in excess of the gauge pressure of the pressure regulator.

2. The apparatus of claim 1 further including means within said back pressure regulator for delivering ink to a print head at a pressure regulated directly with respect to atmospheric pressure.

3. The apparatus of claim 1 further including an ink-jet print head having means for ejecting droplets of ink on command on to a printing medium and a second ink conduit connected between the pressure regulator and print head.

4. The apparatus of claim 3 wherein the ink-jet print head is releasably connectable to the pressure regulator by the second ink conduit.

5. The apparatus of claim 3 further including a printer having:

a) a stationary mounting for retaining the reservoir with respect to the printer;

b) a movable carriage within the printer for releasably retaining the print head and the pressure regulator; and c) a drive motor for moving the movable carriage, the pressure regulator, and ink-jet print head within the printer with respect to the stationary mounting and the reservoir, said drive motor being operatively connected between the movable carriage and the printer.

6. The apparatus of claim 3 further including a printer having:

a) a movable carriage within the printer retaining the print head, the reservoir, and the pressure regulator; and b) a drive motor for moving the movable carriage, the reservoir, the pressure regulator, and the ink-jet print head within the printer, said drive motor being operatively connected between the movable carriage and the printer.

7. The apparatus of claim 3 wherein the print head and pressure regulator are proximate and move together.

8. The apparatus of claim 3 wherein the print head and the pressure regulator are adjacent and move together and the second ink conduit is positioned between the pressure regulator and the print head.

9. Apparatus for providing ink to a print head, comprising:

a) a print head having means for ejecting droplets of ink on command on to a printing medium; and b) a pressure regulator for receiving ink from an ink reservoir and for delivering ink to the print head at a gauge pressure; and c) an ink conduit connected between the print head and the pressure regulator.

10. The apparatus of claim 9 wherein the droplets of ink each have a volume and the pressure regulator further includes means for maintaining a substantially constant droplet volume while the flow of ink from the ink reservoir varies within a range defined by zero flow of ink to a maximum flow of ink.

11. Apparatus for providing ink to a print head, comprising:

a) a print head having means for ejecting droplets of ink on command on to a printing medium;

b) a pressure regulator for receiving ink from an ink reservoir and for delivering ink to a print head, said pressure regulator being in fluid communication with the print head;

c) a nozzle within the pressure regulator and in fluid communication with the print head having an inner diameter sufficiently large to accommodate a blackout printing flow rate of ink to the print head;

d) a valve operatively connected to the nozzle and a valve seat both within the pressure regulator for regulating the flow of ink through the nozzle;

e) a spring within the pressure regulator and operatively connected to the valve for exerting a closing force on the valve, the closing force having a magnitude of more than five times the maximum force exerted by the ink inside of the nozzle; and f) a diaphragm within the pressure regulator and operatively connected to the valve for exerting an opening force on the valve, the opening force having a magnitude of more than five times the maximum force exerted by the ink inside of the nozzle.

12. The apparatus of claim 11 wherein the diaphragm is connected to a lever within the pressure regulator, said lever having neutral buoyancy in the ink within the apparatus.

13. The apparatus of claim 11 wherein a perpendicular of a perpendicular of a surface of a lever is parallel to a direction of acceleration of a printhead.

14. Apparatus for providing ink to a print head, comprising:

a) a print head for ejecting droplets of ink on command on to a printing medium;

b) a pressure regulator for receiving ink from an ink reservoir and for delivering ink to the print head, said pressure regulator being in fluid communication with the print head; and c) a valve and a valve seat within the pressure regulator, said valve and valve seat regulate the pressure of the ink delivered to the print head, when shut said valve and valve seat having an area of mutual contact and a valve sealing pressure, said valve having a tapered nozzle for reducing the area of contact between the valve and the valve seat and thereby increasing the valve sealing pressure.

15. Apparatus for providing ink to a print head, comprising:

a) a print head for ejecting droplets of ink on command on to a printing medium;

b) a pressure regulator for receiving ink from an ink reservoir and for delivering ink to the print head, said pressure regulator being in fluid communication with the print head;

c) a valve and a valve seat within the pressure regulator, said valve and valve seat regulate the pressure of the ink delivered to the print head; and d) a diaphragm within the pressure regulator that responds to negative pressure developed by the print head and applies an opening force on the valve.

16. The apparatus of claim 15 further including:

a) a lever within the pressure regulator for actuating the valve; and b) a hinge pivotally mounted to the lever for rotation about an axis, said diaphragm and valve seat each having a moment arm about said axis of rotation and said diaphragm moment arm being greater than the valve seat moment arm.

17. Apparatus for providing ink to a print head, comprising:

a) a print head for ejecting droplets of ink on command on to a printing medium;

b) a pressure regulator for receiving ink from an ink reservoir and for delivering ink to the print head, said pressure regulator being in fluid communication with the print head;

c) a valve and a valve seat within the pressure regulator, said valve and valve seat regulate the pressure of the ink delivered to the print head; and d) a compression spring within the pressure regulator and operatively connected to the valve that applies a closing force on the valve.

18. The apparatus of claim 17 wherein the compression spring is substantially planar.

* * * * *